US005802936A

United States Patent [19]

Liu

[11] Patent Number: 5,802,936

[45] **Date of Patent: *Sep. 8, 1998**

[54] TOOL HAVING A ROTATABLE DRIVING STEM

[76] Inventor: Kuo Chen Liu, No. 31, 12th Road, Gong Yeh Chu, Da Li City, Taichung Hsien, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 813,226

[22] Filed: Mar. 7, 1997

[51] Int. Cl.[6] ..... B25B 23/00

[52] U.S. Cl. ..... 81/450; 81/177.4; 81/177.8; 81/490

[58] Field of Search ..... 81/450, 438, 439, 81/440, 177.8, 177.9, 177.6, 177.4, 490

[56] References Cited

U.S. PATENT DOCUMENTS 1,331,348 2/1920 Mangini ..... 81/438
2,921,773 1/1960 Hoelzer ..... 81/177.8
4,010,663 3/1977 Rydberg ..... 81/177.6
5,421,225 6/1995 Chen ..... 81/177.4
5,499,562 3/1996 Feng ..... 81/438
5,517,885 5/1996 Feng ..... 81/439

*Primary Examiner*—James G. Smith
*Assistant Examiner*—Lee Wilson

[57] ABSTRACT

A tool includes a hub for slidably receiving a shaft which includes one or more projections. A driving stem has a number of internal teeth for engaging with the projection of the shaft. A spring may bias the projection of the shaft to engage with the internal teeth of the driving stem for positioning the driving stem. The driving stem is allowed to rotate about the shaft when the projection of the shaft is disengaged from the internal teeth by depressing the shaft against the spring.

5 Claims, 3 Drawing Sheets

TOOL HAVING A ROTATABLE DRIVING STEM

BACKGROUND OF THE INVENTION

1. Field of the Invention

The present invention relates to a tool, and more particularly to a tool having a rotatable driving stem that may be easily operated.

2. Description of the Prior Art

Typical screw drivers or wrenches comprise a housing or a handle having a space for receiving tool bits. The handle or the driving stem may not be concealed.

The present invention has arisen to mitigate and/or obviate the afore-described disadvantages of the conventional tools.

SUMMARY OF THE INVENTION

The primary objective of the present invention is to provide a tool having a rotatable driving stem that may be easily rotated outward from the handle for driving a fastener.

In accordance with one aspect of the invention, there is provided a tool comprising a body including a hub, a driving stem including a plurality of internal teeth, a shaft slidably engaged in the hub and including at least one projection for engaging with the internal teeth of the driving stem, and means for biasing the projection of the shaft to engage with the internal teeth of the driving stem and for positioning the driving stem relative to the body. The driving stem is allowed to rotate about the shaft when the projection of the shaft is disengaged from the internal teeth.

The body includes a plurality of holes for receiving tool bits.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
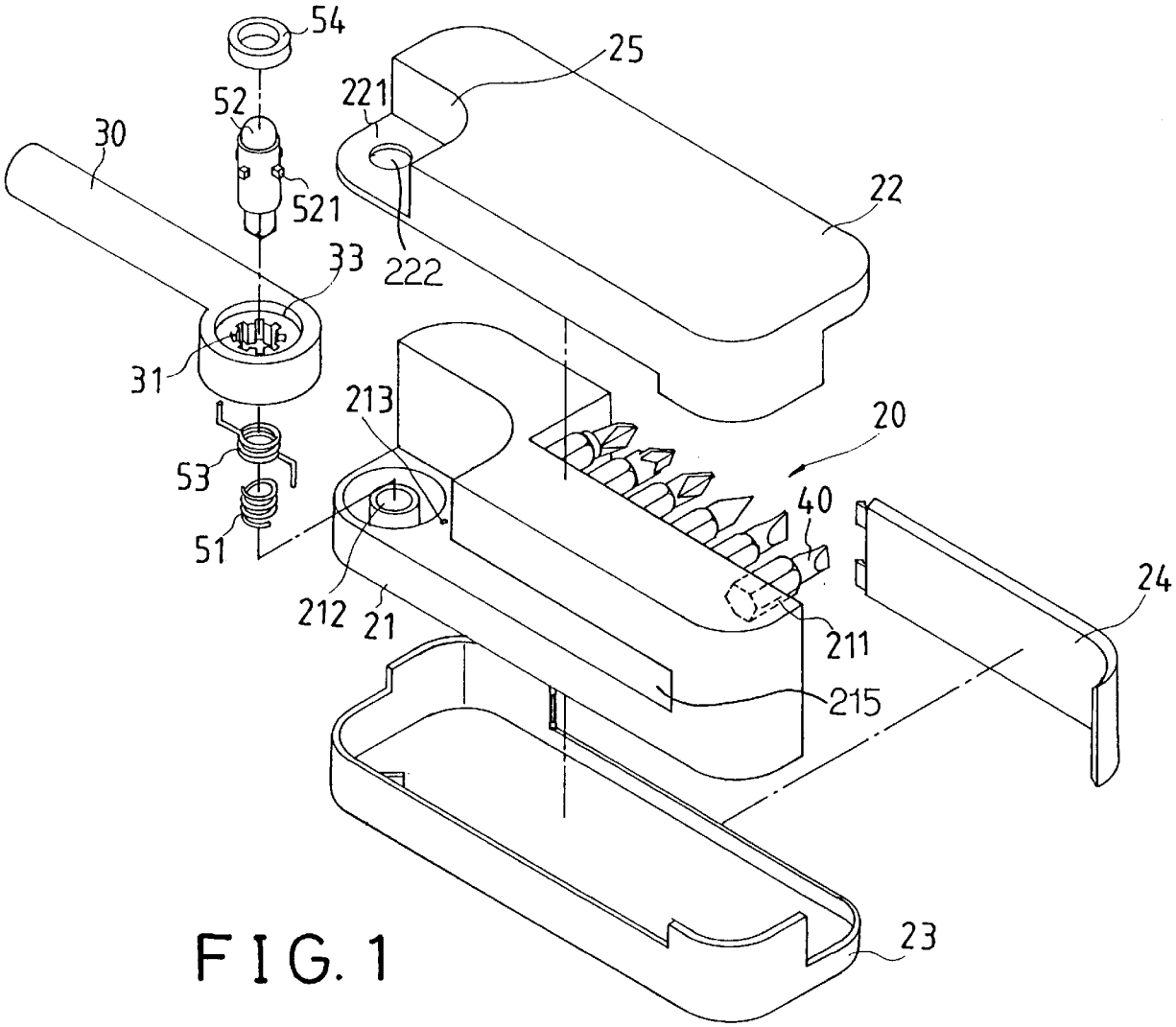
FIG. 1 is an exploded view of a tool in accordance with the present invention.
Figure 2:
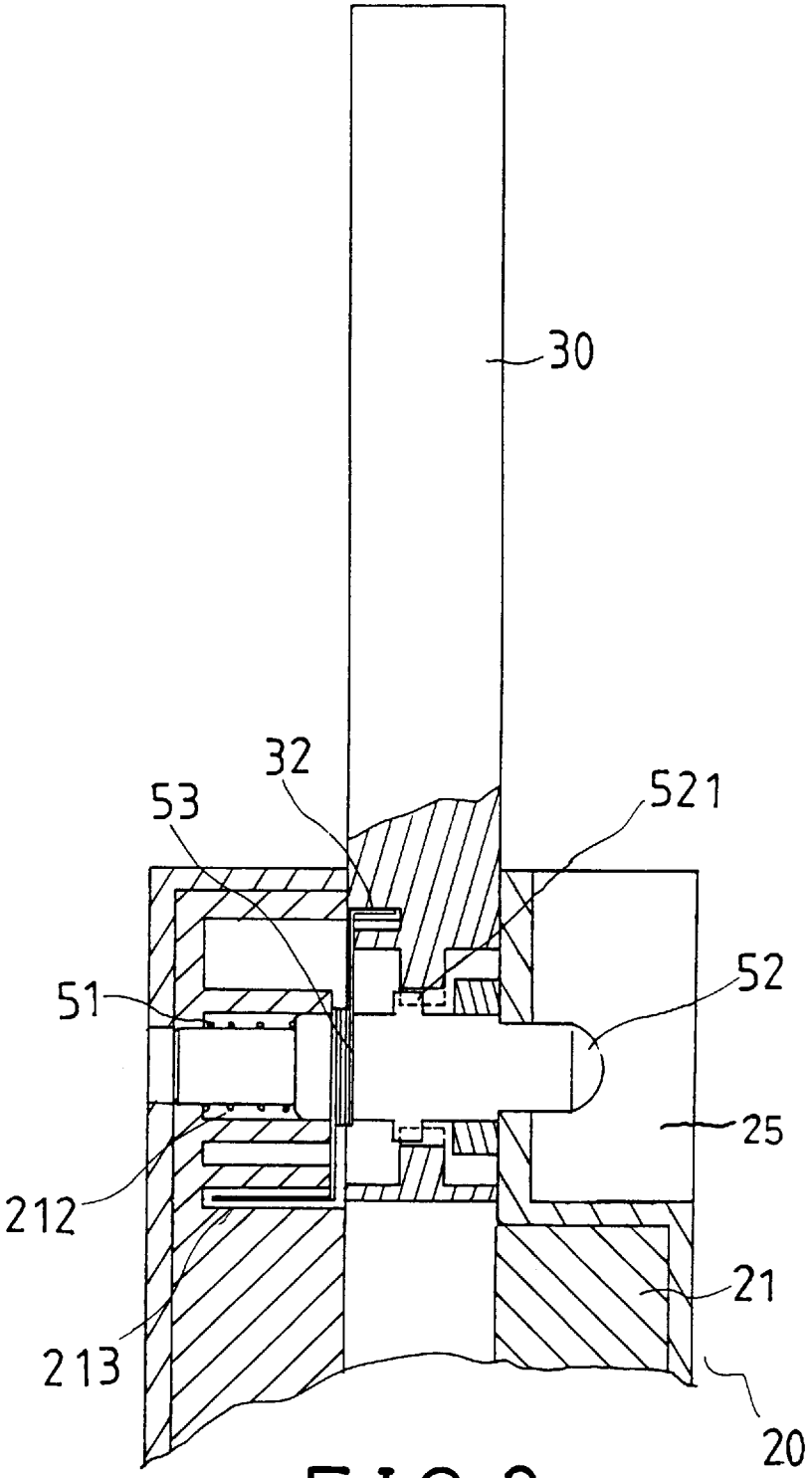
FIG. 2 is a partial cross sectional view of the tool.
Figures 3, 4, 5:
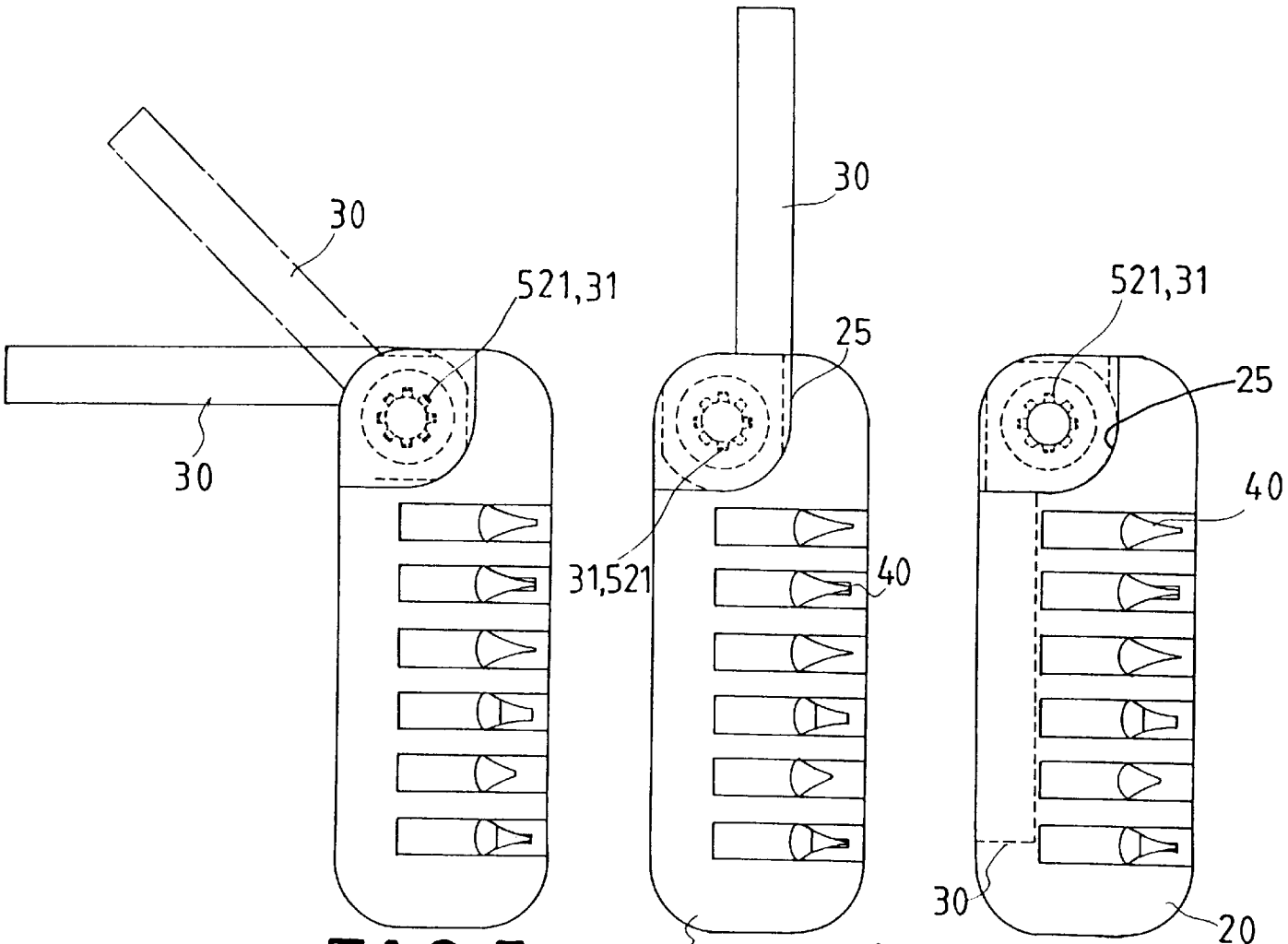
FIGS. 3, 4 and 5 are plane views illustrating the operation of the tool.

Referring to the drawings, and initially to FIGS. 1–3, a tool in accordance with the present invention comprises a handle 20 including a body 21 and a lower cover 23 and an upper cover 22 and a side cap 24. The side cap 24 may be removed for engaging and disengaging the tool bits 40 from the body 21. The body 21 includes a number of holes 211 for engaging with tool bits 40 and includes a hub 212 for receiving a spring 51 and a shaft 52 which includes at least one projection 521. A driving stem 30 includes a number of internal teeth 31 formed in an aperture for engaging with the projection 521 of the shaft 52, and includes a recess 33 for engaging with a washer 54. A spring 53 has one end engaged in a hole 213 of the body 21 and the other end engaged in a hole 32 (FIG. 2) of the driving stem 30, for allowing the spring 53 to rotate the driving stem 30 outward of the body 21 and the handle 20 (FIGS. 4, 5). The upper cover 22 includes a panel 221 for engaging with the washer 54 and includes an orifice 222 for engaging with the shaft 52 and for allowing the upper end of the shaft 52 to be partially biased outward of the panel 221 by the spring 51. The upper cover 22 includes a notch 25 for receiving the upper end of the shaft 52 and for preventing the shaft 52 from being depressed inadvertently. The body 21 includes a cavity 215 for receiving the driving stem 30.

In operation, as shown in FIGS. 3–5, when the shaft 52 is depressed against the spring 51, the projection 521 may be disengaged from the teeth 31 of the driving stem 30 such that the driving stem 30 may be biased and rotated outward of the handle 20 by the spring 53. When the shaft 52 is released, the projection 521 may be biased to engage with either of the teeth 31 of the driving stem 30 so as to position the driving stem 30 at any suitable angular position. The driving stem 30 may engage with the tool bits 40 for driving fasteners.

Accordingly, the tool in accordance with the present invention includes a driving stem that may be easily rotated outward from the handle for driving a fastener.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a body including a hub, a driving stem including a plurality of internal teeth, a shaft slidably engaged in said hub and including at least one projection for engaging with said internal teeth of said driving stem, said shaft including an upper portion, means for biasing said at least one projection of said shaft to engage with said internal teeth of said driving stem and for positioning said driving stem relative to said body, wherein said driving stem being allowed to rotate about said shaft when said upper portion of said shaft is depressed against said biasing means causing said at least one projection of said shaft to be disengaged from said internal teeth of said driving stem, and a cover including a panel having an orifice for engaging with said upper portion of said shaft, said cover including a notch for receiving said upper portion of said shaft.

2. The tool according to claim 1, wherein said body includes a cavity for receiving said driving stem and for allowing said driving stem to be folded and engaged in said body for storing purposes.

3. The tool according to claim 2 wherein said biasing means rotates said driving stem outward of said cavity of said body when said upper portion of said shaft is depressed against said biasing means.

4. The tool according to claim 1, wherein said body includes a plurality of holes for receiving tool bits.

5. The tool according to claim 4 further comprising a side cap secured to said body for enclosing the tool bits and for allowing the tool bits to be engaged in and removed from said body.

* * * * *